US006059955A

United States Patent [19]

Cody et al.

[11] Patent Number: 6,059,955

[45] **Date of Patent: *May 9, 2000**

[54] LOW VISCOSITY LUBE BASESTOCK

[75] Inventors: Ian A. Cody; William J. Murphy; David Dumfries, all of Baton Rouge, La.

[73] Assignee: Exxon Research and Engineering Co., Florham Park, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/023,434

[22] Filed: Feb. 13, 1998

[51] Int. Cl.[7] ..... C10G 71/00

[52] U.S. Cl. ..... 208/18; 208/60; 208/20; 208/89; 508/110

[58] Field of Search ..... 208/60, 20, 18, 208/89; 508/110

[56] References Cited

U.S. PATENT DOCUMENTS

| | | | |
|---|---|---|---|
| 3,038,052 | 3/1962 | Ireland et al. | 208/27 |
| 3,248,316 | 4/1966 | Barger et al. | 208/58 |
| 4,900,707 | 2/1990 | Cody et al. | 502/230 |
| 4,906,601 | 3/1990 | Cody et al. | 502/230 |
| 4,919,786 | 4/1990 | Hamner et al. | 208/27 |
| 4,919,788 | 4/1990 | Chen et al. | 208/59 |
| 4,923,588 | 5/1990 | Cody et al. | 208/27 |
| 4,929,795 | 5/1990 | Cody et al. | 585/739 |
| 4,937,399 | 6/1990 | Wachter et al. | 585/749 |
| 4,943,672 | 7/1990 | Hamner et al. | 585/737 |
| 4,959,337 | 9/1990 | Cody et al. | 502/230 |
| 4,975,177 | 12/1990 | Garwood et al. | 208/27 |
| 4,992,159 | 2/1991 | Cody et al. | 208/89 |
| 5,027,528 | 7/1991 | Andersson | 34/1 |
| 5,059,299 | 10/1991 | Cody et al. | 208/27 |
| 5,135,638 | 8/1992 | Miller | 208/27 |
| 5,158,671 | 10/1992 | Cody et al. | 208/264 |
| 5,182,248 | 1/1993 | Cody et al. | 502/230 |
| 5,200,382 | 4/1993 | Cody et al. | 502/204 |
| 5,246,566 | 9/1993 | Miller | 208/27 |
| 5,275,719 | 1/1994 | Baker et al. | 208/58 |
| 5,282,958 | 2/1994 | Santilli et al. | 208/111 |
| 5,290,426 | 3/1994 | Cody et al. | 208/27 |
| 5,300,213 | 4/1994 | Bartilucci et al. | 208/87 |
| 5,358,628 | 10/1994 | Apelian et al. | 208/60 |
| 5,387,346 | 2/1995 | Hartley et al. | 252/49.9 |
| 5,558,807 | 9/1996 | Kim | 508/251 |
| 5,643,440 | 7/1997 | Borghard et al. | 208/58 |

*Primary Examiner*—Walter D. Griffin
*Assistant Examiner*—Nadine Preisch
*Attorney, Agent, or Firm*—James H. Takemoto

[57] ABSTRACT

The present invention is directed to an easily biodegradable low viscosity, low Noack volatility lube oil material having a viscosity index (VI) in the range of about 110–145, >98% saturates useful as lube oil basestock, automatic transmission fluid (ATF) basestock or blending stock. The lube oil material is produced by the isomerization of a wax feed having a viscosity of from 4 to 10 cSt at 100° C. and containing less than about 25% oil in wax.

6 Claims, 5 Drawing Sheets

ATF ( Ad pack 1 )

From: Watts and Bloch :- 'The Effect of Basestock Composition on Automatic Transmission Fluid Performance' NPRA FL 90-118, Nov 1990, Houston, Tx

O = CARBON ATOMS NEAR BRANCHES / ENDS
1-8 = FREE CARBON ATOMS

FCI ( OF STRUCTURE A ) =((8/26)x100)x(26/100) = 8

LOW VISCOSITY LUBE BASESTOCK

FIELD OF THE INVENTION

This invention relates to a method for making low viscosity, high Viscosity Index (VI) lube oil materials useful as light lubricating oil basestocks or blending stocks, especially automatic transmission fluid (ATF) basestocks or blending stocks and to the formulated products produced using such stocks.

DESCRIPTION OF THE RELATED ART

Wax isomerate oils are a developing, high quality alternative to mineral oils as lube basestocks. Such oils have found application in a variety of uses such as passenger car motor oils and greases.

Wax isomerate oils and methods for their preparation are described in numerous patent references including U.S. Pat. Nos. 3,308,052; 5,059,299; 5,158,671; 4,906,601; 4,959,337; 4,929,795; 4,900,707; 4,937,399; 4,919,786; 5,182,248; 4,943,672; 5,200,382; 4,992,159; 4,923,588; 5,290,426; 5,135,638; 5,246,566; 5,282,958; 5,027,528; 4,975,177; 4,919,788.

Automatic transmission fluids (ATF's) are divided into two main groups, friction modified fluids and non-friction modified fluids and are used in automotive and commercial vehicle service. The friction modified and non-friction modified fluids are generally similar in their basic requirements; high thermal and oxidation resistance, low temperature fluidity, high compatibility, foam control, corrosion control and anti-wear properties. Both types of fluids have similar friction properties at high sliding speeds. Different automatic transmission manufacturers do require somewhat different properties in the fluids used as sliding speed approaches zero (clutch lock-up). Some manufacturers specify that the ATF's used with their transmissions exhibit a decrease in friction coefficient (i.e., more slipperiness) while others want an increase in friction coefficient. ATF's contain detergents, dispersants, anti-wear, anti-rust, friction modifiers and anti-foaming agents. The fully formulated fluid must be compatible with synthetic rubber seals used in automatic transmissions. Current fully-formulated ATF's have kinematic viscosity (cSt) between 30 and 60 at 40° C., between about 4.1 to 10 at 100° C.; Brookfield viscosity of 200 poise at about −30 to about −45° C., 100 poise at about −26 to −40° C., and 50 poise at about −21 to about −35° C.; flash points (COC) between about 150 to about 220° C.; pour point between about −36 to 48° C., Color (ASTM) between about 2 to about 2.5; and an operating temperature range between about −35 to about 80° C.

As the performance requirements of ATF's increase, basestocks other than mineral oil will have to be considered; however, in addition to meeting additional and increasingly stringent operating and performance specification, it will be desirable, if not absolutely necessary that future lubricating oil product such as motor lube oils, automatic transmission fluids, etc., be environmentally friendly, as evidenced by high biodegradability.

SUMMARY OF THE INVENTION

This invention relates to a method of making a wax isomerate oil characterized by having a viscosity of from about 3.0 to 5.0 cSt at 100° C., a Noack volatility at 250° C. of from 10 to 40, a viscosity index of from 110 to 160, a saturates content greater than 98% and a pour point of less than −20° C. which comprises the steps of hydrotreating a wax having a mean boiling point of from 400 to 500° C. and having a standard deviation (ρ) of about 20 to 45° C., containing not more than 20% oil and having a viscosity of from 4–10 cSt at 100° C., said hydrotreating being conducted at a temperature of from 280 to 400° C., a pressure of from 500 to 3,000 psi $H_2$, a hydrogen treat gas rate of from 500 to 5,000 SCF $H_2$/bbl and a flow velocity of from 0.1 to 2.0 LHSV, isomerizing the hydrotreated wax over an isomerization catalyst to a level of conversion of at least 10% conversion to 370° C. (HIVAC topping), fractionating the resulting isomerate to recover a fraction having a viscosity in the range about 3.0 to 5.0 cSt at 100° C. and boiling above about 340° C., and dewaxing the recovered fraction.

In another embodiment, this invention is based on the discovery that for an isoparaffinic basestock, there is a relationship between the viscosity of the basestock at 100° C. (V100) and the structure of the isoparaffin, i.e, its "free carbon index" (FCI) that is prepared for ATF's. The relationship is expressed by the equation $P=(V100)^2FCI$. For ATF's, P should not exceed 50. Thus, this invention also concerns an isoparaffinic basestock suitable for an automatic transmission fluid having a viscosity at 100° C. (V100) equal to or greater than 3.0 cSt and a free carbon index (FCI) such that the product, P, in the equation $P=(V100)^2FCI$, does not exceed 50.

Yet another embodiment concerns an automatic transmission fluid comprising a major portion of an isoparaffinic basestock having a viscosity at 100° C., (V100), greater than 3.0 cSt and a FCI such that the product, P, in the equation $P=(V100)^2FCI$ does not exceed 50; and a minor portion of an additive package comprising at least one of pour point depressant, viscosity index improves, flow improver, detergents, inhibitors, seal swelling agents, anti-rust agents and antifoaming agents.

These and other embodiments of the invention will be described in detail below.

DETAILED DESCRIPTION OF THE INVENTION

The present invention is directed to a method for making a low viscosity lube oil material having a saturates content greater than 98% saturates and useful as a light lubricating and base stock or blending stock for passenger car motor oils and heavy duty diesel oils, and especially useful as an automatic transmission fluid (ATF) basestock producing a formulated ATF having a Brookfield viscosity of less than about 10,000 cSt −40° C.

The lube oil material made by the method according to the invention is characterized by its high biodegradability, its low viscosity, low Noack volatility and high saturate content.

The lube oil material's biodegradability, as determined by the CEC-L-33-82 test is greater than about 70%, preferably greater than about 80%, more preferably greater than about 85%, most preferably greater than about 90%.

The CEC-L-33-82 test (hereinafter CEC test) is a popular and widely used test in Europe for determining the biodegradability of material. The test is a measure of primary biodegradation and follows the decrease in the methylene C-H stretch in the infrared (IR) spectrum of the material. The test is an aerobic aquatic test which utilizes microorganisms from sewage plants as the waste digestion innoculum. Because of the inevitable variability in the microorganisms, direct comparisons of data generated using microorganisms from different sources (or even the same source but collected at different times) should not be undertaken. Despite the variability, however, the CEC test is valuable as a statistical tool and as a means for demonstrating and observing biodegradation trends. In absolute terms, however, the CEC test is employed to determine whether a waste or oil meets and passes the German "Blue Angel" standard which provides that regardless of microorganism source, the oil or waste is 80% biodegraded in 21 days.

Automatic transmission fluids and hydraulic oils in the future will have to meet increasingly severe requirements, including lower Brookfield viscosities and high biodegradability. Currently ATF's must meet a Brookfield viscosity of about 15,000 cSt at −40° C. but in the future Brookfield viscosities less than 15,000 cSt, and preferably less than about 10,000 cSt at −40° C. will be required with those oils exhibiting CEC biodegradability of 80 and higher. PAO's currently exhibit Brookfield viscosities of about 3600 depending of the additive package but have biodegradability in the 50 to 80 range.

Figure 4:
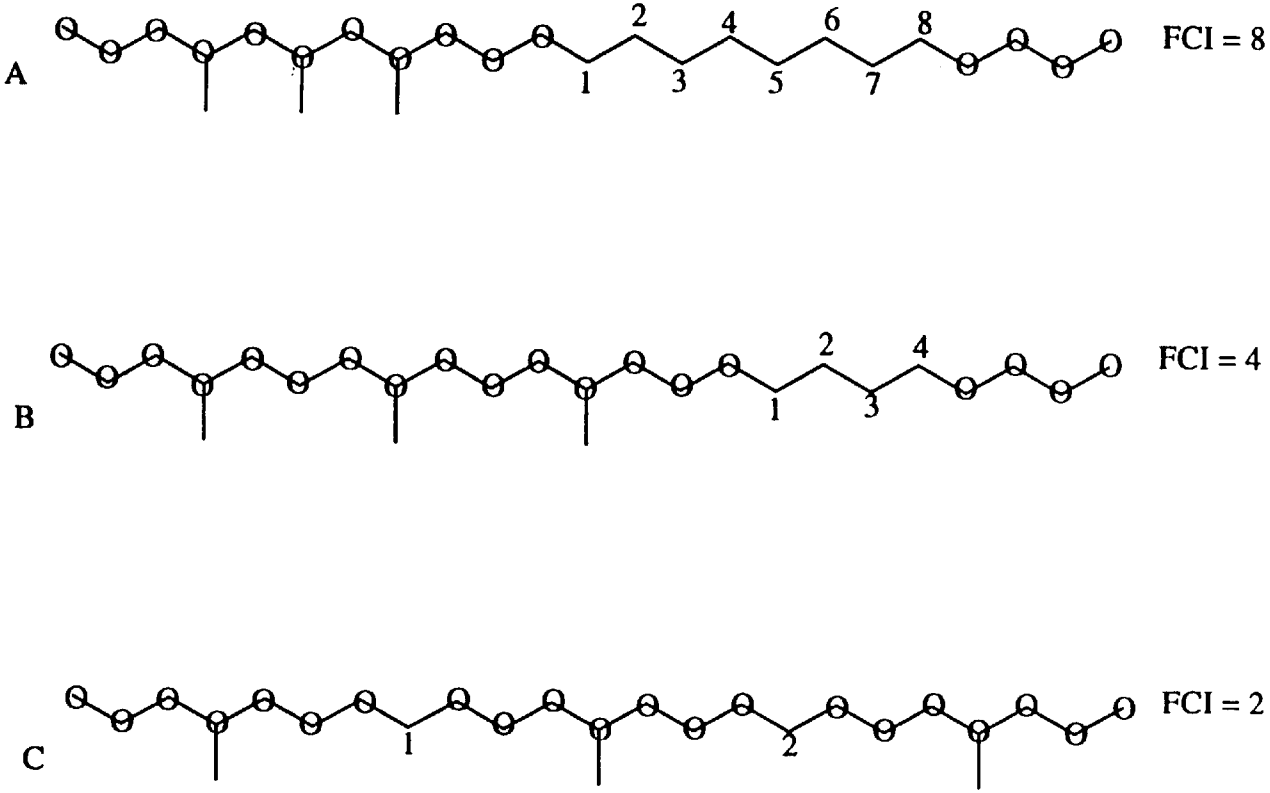
FIG. 4 is a schematic representative of three isoparaffins having a different Free Carbon Index.

It has been unexpectedly discovered that formulated ATF's using basestock prepared according to the teaching of the invention exhibit Brookfield viscosities below about 10,000 provided the product, P, in the equation $P=(V100)^2FCI$ is less than 50, where V100 is the viscosity at 100° C. of the isoparaffinic basestock and FCI is the free carbon index of the basestock. In a preferred embodiment, P is in the range of 15 to 45. The "Free Carbon Index" is a measure of the number of carbon atoms in an isoparaffin that are located at least 4 carbons from a terminal carbon and more than 3 carbons away from a side chain. Therefore, in FIG. 4 structure A has 8 carbon atoms which meet this criteria and hence A has a FCI of 8. Similarly, structures B and C have FCI's of 4 and 2 respectively. The FCI of an isoparaffin basestock can be determined by measuring the percent of methylene groups in an isoparaffin sample using $^{13}C$ NMR (400 megahertz); multiplying the resultant percentages by the calculated average carbon number of the sample determined by ASTM Test Method 2502 and dividing by 100.

The FCI is further explained as follows based on $^{13}C$ NMR analysis using a 400 MHz spectrometer. All normal paraffins with carbon numbers greater than $C_9$ have only five non-equivalent NMR adsorptions corresponding to the terminal methyl carbons ($\alpha$) methylenes from the second, third and forth positions from the molecular ends ($\beta$, $\gamma$, and $\delta$ respectively), and the other carbon atoms along the backbone which have a common chemical shift ($\epsilon$). The intensities of the $\alpha$, $\beta$, $\gamma$ and $\delta$ are equal and the intensity of the $\epsilon$ depends on the length of the molecule. Similarly the side branches on the backbone of an iso-paraffin have unique chemical shifts and the presence of a side chain causes a unique shift at the tertiary carbon (branch point) on the backbone to which it is anchored. Further, it also perturbs the chemical sites within three carbons from this branch point imparting unique chemical shifts ($\alpha'$, $\beta'$, and $\gamma'$).

The Free Carbon Index (FCI) is then the percent of $\epsilon$ methylenes measured from the overall carbon species in the $^{13}C$ NMR spectra of the a basestock, divided by the average carbon Number of the basestock as calculated from ASTM method 2502, divided by 100.

Figure 3:
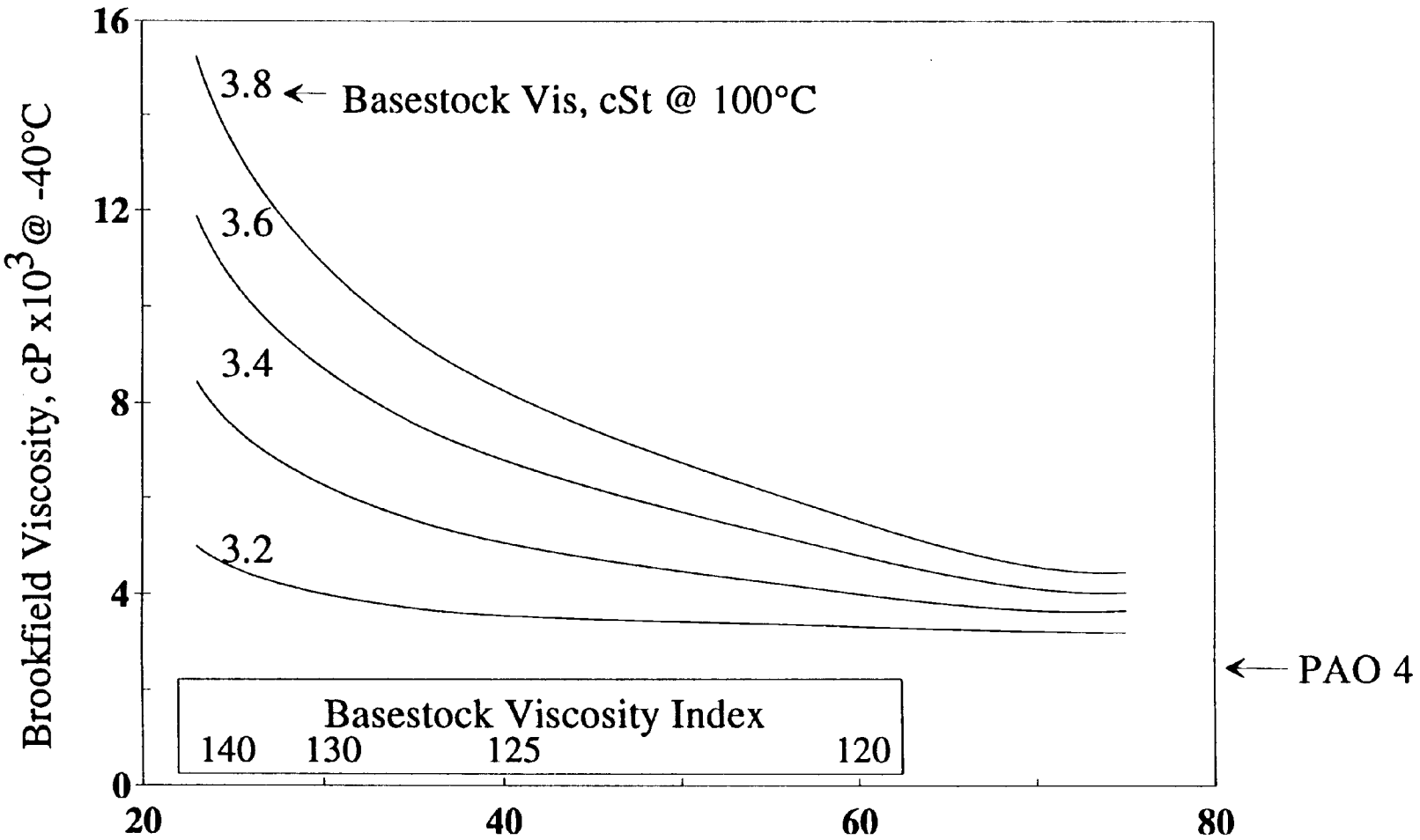
FIG. 3 is a graph showing that Brookfield viscosity is influenced by isomerization conversion level, isomerate fractionation cut point and that contrary to conventional understanding, for the products of the present invention Brookfield viscosity goes down (improves) as VI goes down.

FIG. 3 presents the relationship which exists between Brookfield viscosity at −40° C. and conversion to 370° C. including Viscosity Index for a number of sample fractions of isomerate made from wax samples hydrotreated at different levels of severity. The oils of different viscosities are recovered by taking different fractions of the obtained isomerate. As is seen, Brookfield viscosity improves (i.e., decreases) as Viscosity Index decreases. This is just the opposite of what is the current understanding of those skilled in the art.

The lube oil material of the present invention is prepared by hydroisomerizing a wax feed which can be either a natural wax, such as a petroleum slack wax obtained by solvent dewaxing hydrocarbon oils, or a synthetic wax such as that produced by the Fischer Tropsch process using synthesis gas.

The wax feed is selected from any natural or synthetic wax exhibiting the properties of a 100 to 600 N wax, preferably a 100 to 250 N wax, having a mean boiling point in the range of about 400° C. to 500° C., preferably about 420° C. to 450° C. and having a standard deviation ($\rho$) of about 20 to 45° C., preferably about 25° C. to 35° C. and containing about 25% or less oil. Waxes having viscosity at 100° C. in the range of about 4 to 10 cSt are appropriate feeds for conversion by hydroisomerization into the low viscosity lube base stock material of the present invention.

Wax feeds secured from natural petroleum sources (i.e., slack waxes) contain quantities of sulfur and nitrogen compounds which are both undesirable in the final lube oil material produced (as well as any formulated product made using the material) and are known to deactivate isomerization catalysts, particularly the noble metal isomerization catalysts such as platinum on fluorided alumina.

It is, therefore, desirable that the feed contain no more than 1 to 20 ppm sulfur, preferably less than 5 ppm sulfur and no more than 5 ppm nitrogen, preferably less than 2 ppm nitrogen.

To achieve these ends the feed can be hydrotreated if necessary to reduce the sulfur and nitrogen contents.

Hydrotreating can be conducted using any typical hydrotreating catalyst such as Ni/Mo on alumina, Co/Mo on alumina, Co/Ni/Mo on alumina, e.g., KF-840, KF-843, HDN-30, HDN-60, Criteria C-411, etc. Bulk catalysts as described in U.S. Pat. No. 5,122,258 can also be used and are preferred.

Hydrotreating is performed at temperatures in the range 280° C. to 400° C., preferably 340° C.–380° C., most preferably 345° C.–370° C., at pressures in the range 500 to 3,000 psi $H_2$ (3.45 to 20.7 mPa), at hydrogen treat gas rate in the range 500 to 5,000 SCF/B (89 to 890 $m^3$ of $H_2/m^3$ of oil), and at flow velocity of 0.1 to 2.0 LHSV.

Figure 2:
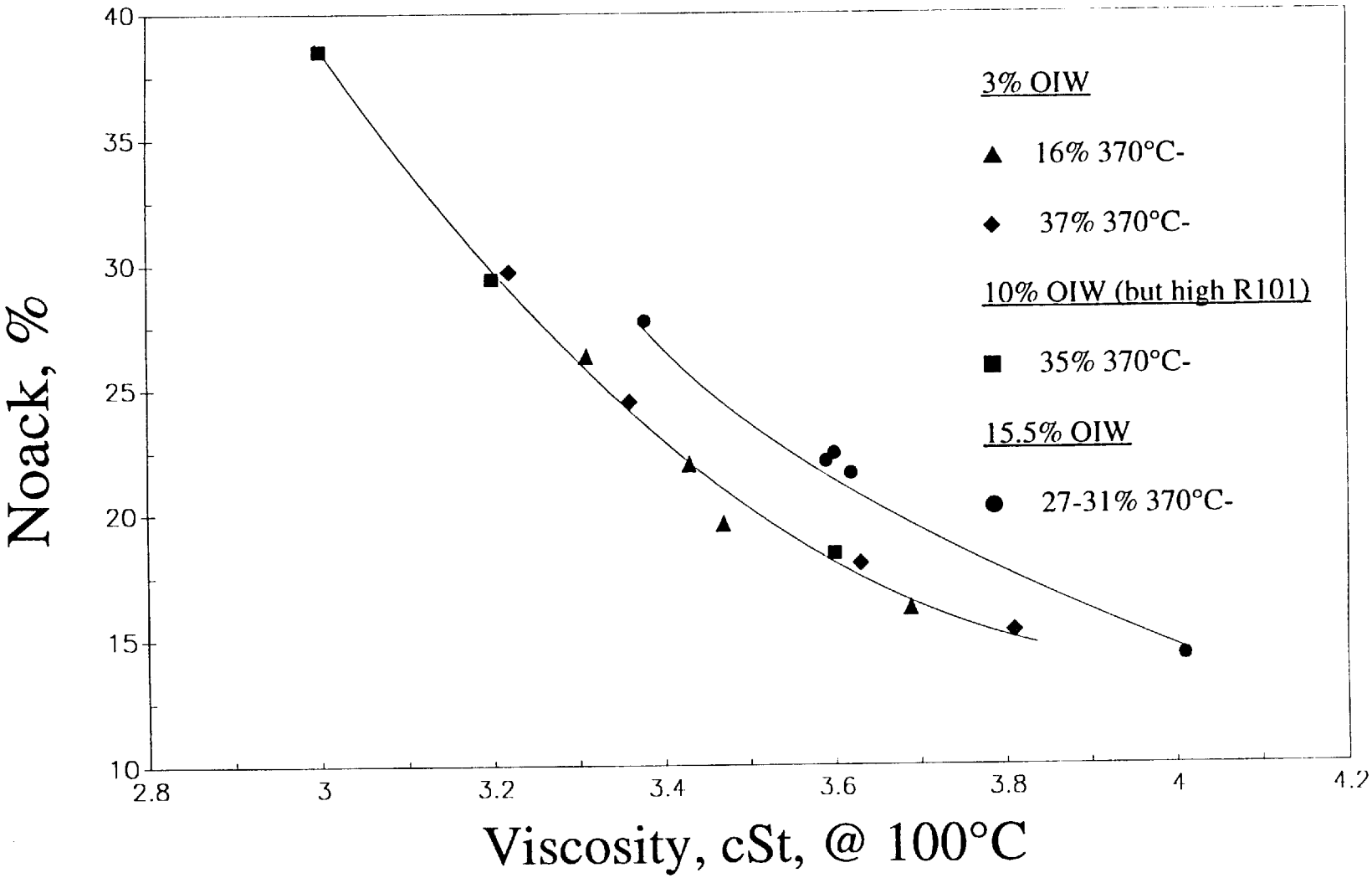
FIG. 2 is a graph showing the relationship which exists between the Noack volatility and viscosity of three oil samples made by hydroisomerizing 150 N wax samples having three different oil contents and the effect different wax hydrotreating conditions have on that relationship.

When dealing with feed wax having oil contents greater than about 5% oil in wax (OIW) it is preferred that the hydrotreating be conducted under conditions at the more severe end of the range recited, i.e., for wax feeds having OIW greater than about 5% hydrotreating is preferably conducted at temperatures in the range 340° C.–380° C. with the higher temperatures in the range being employed with the higher oil content waxes. Thus, for wax feeds having about 10% OIW hydrotreating at a temperature of about 365° C. is preferred as compared to hydrotreating at 345° C. which is generally sufficient for wax feeds of lower oil content (3–5% or less). This is especially true when the object is to produce a product meeting a specific product specification. Thus if the goal is to produce a lube material suitable for ATF application having a kinematic viscosity of about 3.5 cSt at 100° C. and a Noack volatility of about 20 at 250° C. and a pour point of about −25° C. from a feed having more than 5% OIW wax feed, in high yield, it is preferred that the feed be hydrotreated at above 345° C., preferably above about 365° C. as shown in FIG. 2.

The hydrotreated feed is then contacted with an isomerization catalyst under typical hydroisomerization conditions to achieve a conversion level of less than 75% conversion to 370° C. (HIVAC topping), preferably about 35%–45% of conversion 370° C. Conditions employed include a temperature in the range, about 270° C. to 400° C., preferably about 300° C. to 360° C., a pressure in the range about 500 to 3000 psi $H_2$, (3.45 to 20.7 mPa), preferably 1000 to 1500 psi $H_2$ (6.9 to 10.3 mPa), a hydrogen treat gas rate in the range about 100 to 10,000 SCF $H_2$/B (17.8 to 1780 $m^3/m^3$), and a flow rate of about 0.1 to 10 v/v/hr, preferably about 1 to 2 v/v/hr.

The isomerate recovered is then fractionated and solvent dewaxed. The fractionation and dewaxing can be practiced in any order, but it is preferred that the dewaxing follows fractionation as then a smaller volume of material needs to be treated.

The isomerate is fractionated to recover that fraction having the desired kinematic viscosity at 100° C. Typically, the factors affecting fractionation cut point will be degree of conversion and oil-in-wax content.

Dewaxing is practiced using any of the typical dewaxing solvents such as ketones, e.g., methyl ethyl ketone, (MEK), methyl isobutyl ketone (MIBK), aromatics hydrocarbons, e.g., toluene, mixtures of such materials, as well as autorefrigerative dewaxing solvents such as propane, etc. Preferred dewaxing solvents are MEK/MIBK used in a ratio of about 3:1 to 1:3 preferably 50:50, at a dilution rate of on feed about 4 to 1, preferably about 3 to 1.

The dewaxing is conducted to achieve a pour point of about −20° C. and lower.

The isomerate is fractionated to recover that portion boiling above about 340° C. (340° C. cut point).

Hydroisomerization, as previously stated, is conducted so as to achieve wax conversion of 20 to 75% to 370° C. material, preferably wax conversion of 35%–45% to 370° C. material as determined by HIVAC topping.

The isomerization catalyst component can be any of the typical isomerization catalyst such as those comprising refractory metal oxide support base (e.g., alumina, silica-alumina, zirconia, titanium, etc.) on which has been deposited a catalytically active metal selected from the group consisting of Group VI B, Group VII B, Group VIII metals and mixtures thereof, preferably Group VIII, more preferably noble Group VIII, most preferably Pt or Pd and optionally including a promoter or dopant such as halogen, phosphorus, boron, yttria, magnesia, etc. preferably halogen, yttria or magnesia, most preferably fluorine. The catalytically active metals are present in the range 0.1 to 5 wt. %, preferably 0.1 to 3 wt. %, more preferably 0.1 to 2 wt. %, most preferably 0.1 to 1 wt. %. The promoters and dopants are used to control the acidity of the isomerization catalyst. Thus, when the isomerization catalyst employs a base-material such as alumina, acidity is imparted to the resultant catalyst by addition of a halogen, preferably fluorine. When a halogen is used, preferably fluorine, it is present in an amount in the range 0.1 to 10 wt. %, preferably 0.1 to 3 wt. %, more preferably 0.1 to 2 wt. %, most preferably 0.5 to 1.5 wt. %. Similarly, if silica-alumina is used as the base material, acidity can be controlled by adjusting the ratio of silica to alumina or by adding a dopant such as yttria or magnesia which reduces the acidity of the silica-alumina base material as taught on U.S. Pat. No. 5,254,518 (Soled, McVicker, Gates, Miseo).

The catalyst used can be characterized in terms of their acidity. The acidity referred to herein is determined by the method described in "Hydride Transfer and Olefin Isomerization as Tools to Characterize Liquid and Solid Acids", McVicker and Kramer, Acc Chem Res 19, 1986, pg. 78–84.

This method measures the ability of catalytic material to convert 2-methylpent-2-ene into 3 methylpent-2-ene and 4 methylpent-2-ene. More acidic materials will produce more 3-methylpent-2-ene (associated with structural rearrangement of a carbon atom on the carbon skeleton). The ratio of 3-methylpent-2-ene to 4-methypent-2-ene formed at 200° C. is a convenient measure of acidity.

Isomerization catalyst acidities as determined by the above technique lies in the ratio region in the range of about 0.3 to about 2.5, preferably about 0.5 to about 2.0.

For a number of catalysts, the acidity as determined by the McVicker/Kramer method, i.e., the ability to convert 2-methylpent-2-ene into 3-methylpent-2-ene and 4-methylpent-2-ene at 200° C., 2.4 w/h/w, 1.0 hour on feed wherein acidity is reported in terms of the mole ratio of 3-methylpent-2-ene to 4-methylpent-2-ene, has been correlated to the fluorine content of platinum on fluorided alumina catalyst and to the yttria content of platinum on yttria doped silica/alumina catalysts. This information is reported below.

Acidity of 0.3% Pt on fluorided alumina at different fluorine levels:

| F Content (%) | Acidity (McVicker/Kramer) |
|---|---|
| 0.5 | 0.5 |
| 0.75 | 0.7 |
| 1.0 | 1.5 |
| 1.5 | 2.5 |
| 0.83 | 1.2 (interpolated) |

Acidity of 0.37. Pt on yttria doped silica/alumina initially comprising 25 wt. % silica:

| Yttria Content (%) | Acidity (McVicker/Kramer) |
|---|---|
| 4.0 | 0.85 |
| 9.0 | 0.7 |

It is taught in U.S. Pat. No. 5,565,086, which teaching is incorporated herein by reference, that a preferred catalyst is one made by employing discrete particles of a pair of catalysts selected from those recited above and having acidities in the recited range wherein there is an about 0.1 to about 0.9 mole ratio unit difference between the pair of catalysts, preferably an about 0.1 to about 0.5 mole ratio and difference between the catalyst pair.

For those alumina based catalysts which do not exhibit or demonstrate acidity, for example, as a consequence of their having little or no silica in the support, acidity can be impacted to the catalyst by use of promoters such a fluorine, which are known to impact acidity to catalyst, according to techniques well known in the art. Thus, the acidity of a platinum on alumina catalyst can be very closely adjusted by controlling the amount of fluorine incorporated into the catalyst. Similarly, the low acidity and high acidity catalyst particles can also comprise materials such as catalytic metal incorporated onto silica alumina. The acidity of such a catalyst can be adjusted by careful control of the amount of silica incorporated into the silica-alumina base or as taught in U.S. Pat. No. 5,254,518, the acidity of starting a high acidity silica-alumina catalyst can be adjusted using a dopant such as rare earth oxides such as yttria or alkaline earth oxide such as magnesia.

The lube oil material produced by the process is useful as a low viscosity lube oil base stock or blending stock. It is especially useful as an automatic transmission fluid base stock.

Such base stock is combined with additives (adpack) to produce a formulated ATF product. Typically automatic transmission fluid adpacks will contain a detergent-inhibitor pack, a VI improver, seal sweller and a pour depressant. The amounts of these components in a given adpack varies with adpack used and with base stock. The treat level also varies depending on the particular adpack employed. Typical adpacks currently used in the industry include HiTec 434 which is a proprietary formulation of Ethyl Corporation. Adpacks are typically employed in the range of from 5 to 30 wt. %, based on ATF formulation, with the balance being base stock.

Figure 1:
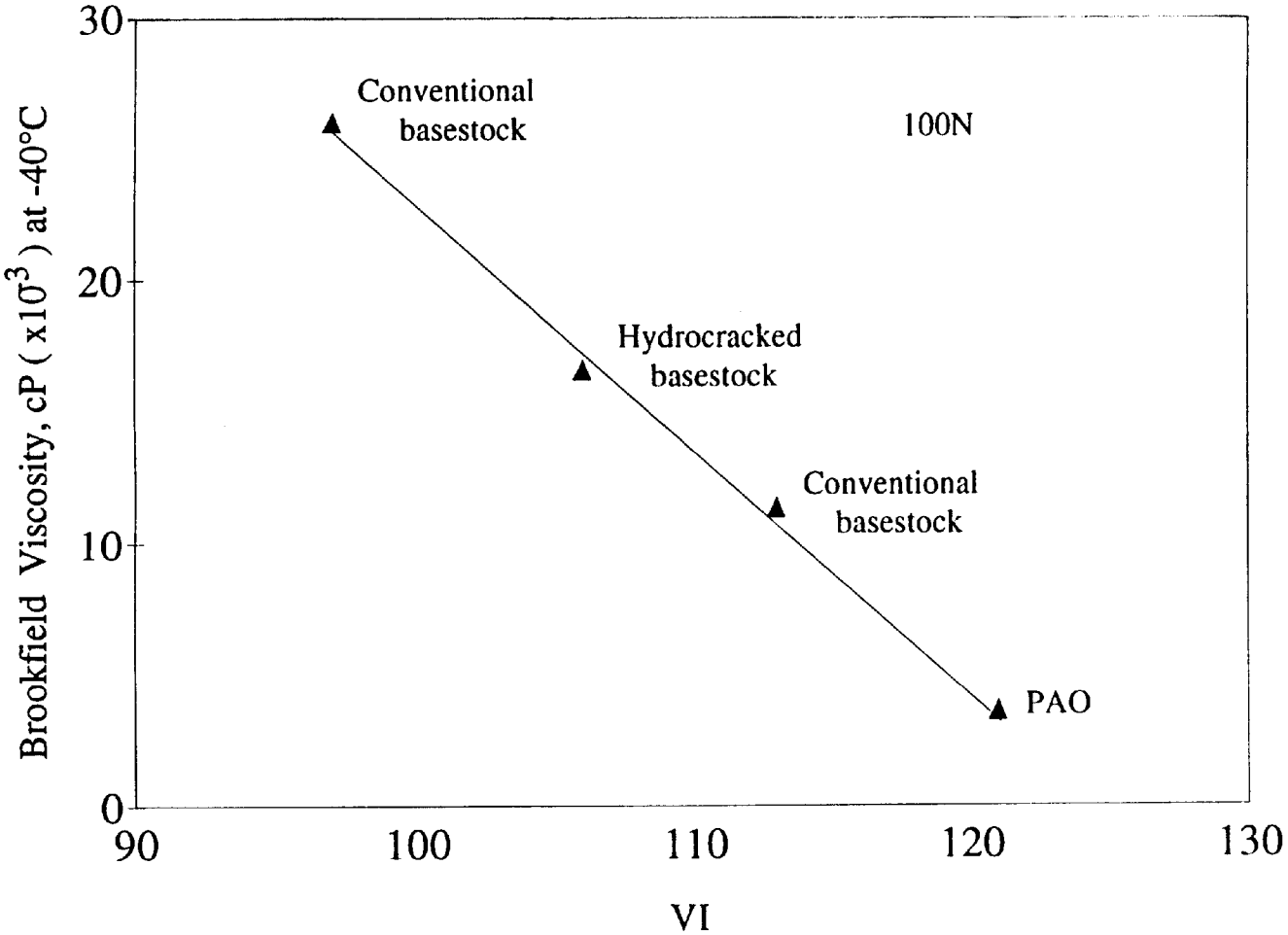
FIGS. 1(*a*) and (*b*) are graphs showing the relationship between Brookfield viscosity and viscosity index currently accepted in the industry, that is, that Brookfield viscosity goes down as VI goes up.
Figure 1B:
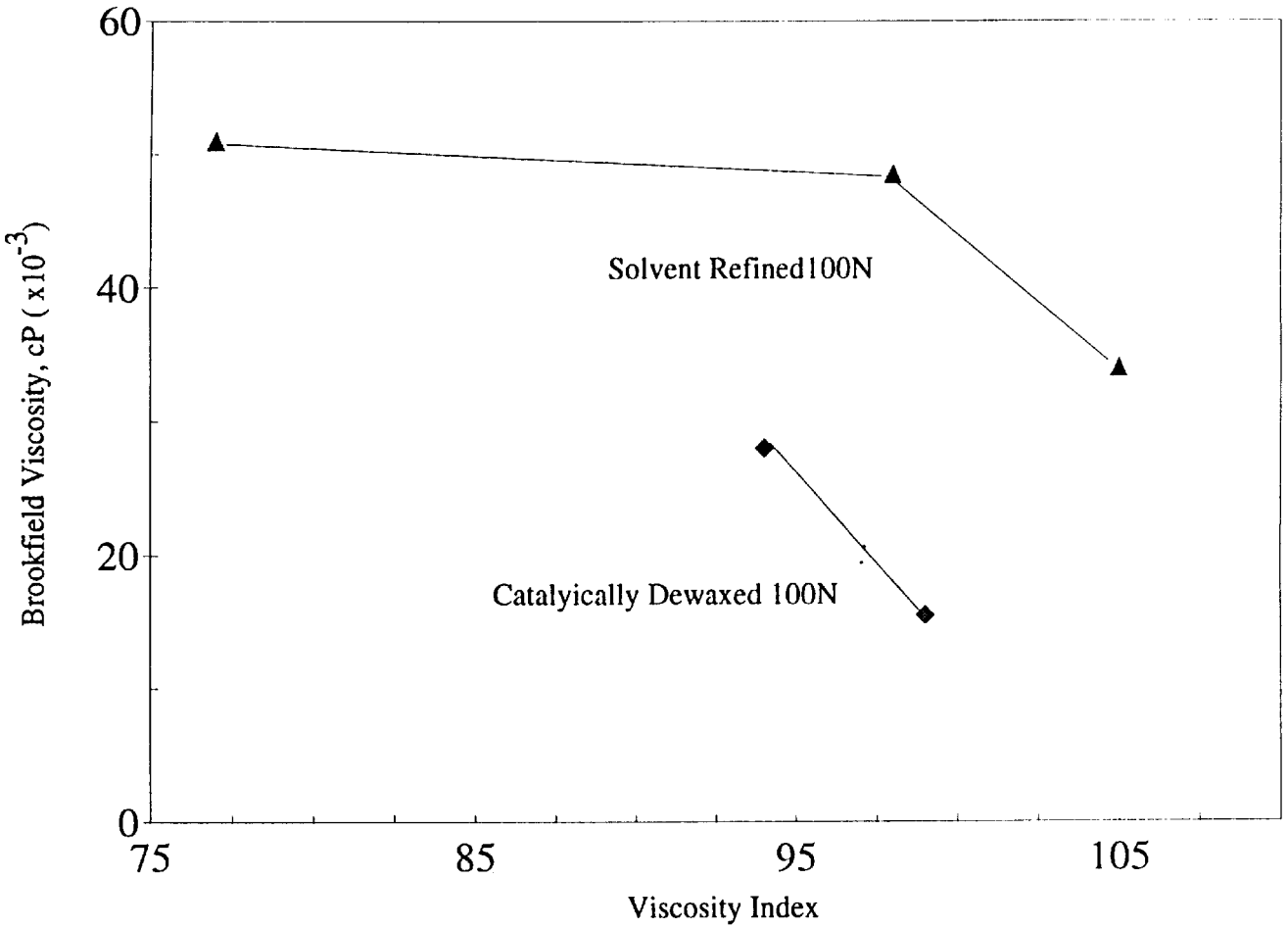

Surprisingly, it has been discovered that contrary to the teaching in the art, in the present invention, Brookfield viscosity of the formulated ATF product improves (goes down) as the VI of the base stock decreases. This behavior can be attributed to the base stock. Based upon the teaching of the literature and data generated for more conventional base stocks, including hydrotreated stocks and poly alpha olefins, one would have expected that to achieve improved Brookfield viscosities (lower Brookfield viscosities), it would have been necessary to increase rather than decrease VI of the base stock used (see FIGS. 1(*a*) and 1(*b*)). FIG. 1(*b*) is taken from Watts and Bloch, "The Effect of Basestock Composition of Automatic Transmission Fluid Performance", NPRA FL 90-118, Nov. 1990, Houston, Tex. In comparison, the basestocks and formulated ATF products of the present invention, Brookfield viscosities decrease as VI decreases (see FIG. 3).

In the following examples various 150 N slack waxes of differing OIW contents were isomerized to product base stock materials for formulation into formulated ATF products.

EXAMPLES

Example 1

150 N slack waxes were hydrotreated over KF-840 catalyst at 345° C., 0.7 v/v/hr, 1000 psig (7.0 mPa) and 1500 SCF/min (42.5 $m^3$/min) hydrogen. The hydrotreated waxes were then isomerized over a Pt/F alumina catalyst at 1.3 v/v/hr, 1000 psig (7.0 mPa), and 2500 SCF/min (70.8 $m^3$/min) hydrogen at the temperatures listed in Tables 1 and 2. The degree of conversion and fractionation conditions are listed in the Tables. The isomerate so obtained was dewaxed using a filter temperature of −24° C. (to give a pour point of −21° C.) and a 50/50 v/v solution of methylethyl ketone/methyl isobutyl ketone. The dewaxed oil was formulated as ATF with HITEC434 and the properties of the formulated fluid are also shown in the Tables.

TABLE 1

| BASESTOCK | | | | | | | |
|---|---|---|---|---|---|---|---|
| Wax Content, wt. % | 89.7 | 89.3 | 89.3 | 89.3 | 89.3 | 89.3 | 89.3 |
| Isom. Temp. (° C.) | 351 | 351 | 356 | 359 | 354 | 351 | 348 |
| Cut Point (° C.) | 351 | 393 | 369 | 367 | | | |
| Conversion (HIVAC) | 35 | 35 | 60 | 75 | 50 | 35 | 24 |
| Wax Content (%) | 8.9 | 12.2 | 1.0 | 0 | 14.5 | 13.8 | 33 |
| Viscosity, 40° C. cSt | 12.72 | 14.73 | 12.89 | 12.89 | 15.48 | 14.97 | 15.05 |
| Viscosity, 100° C. cSt | 3.23 | 3.63 | 3.22 | 3.21 | 3.68 | 3.63 | 3.68 |
| Viscosity Index | 122 | 134 | 117 | 115 | 126 | 129 | 134 |
| Pour Point (° C.) | −23 | −23 | −25 | −26 | −22 | −22 | −20 |
| Noack Volatility (250° C.) % | 29.7 | 18.4 | 29.8 | 30.6 | 17.0 | 18.8 | 17.1 |
| Free Carbon Index (FCI) | 3.6 | 3.7 | 2.8 | 2.12 | 3.4 | 3.7 | 4.4 |
| (V100)2 FCI | 37.6 | 48.8 | 29 | 21.8 | 46 | 48.8 | 59.6 |
| FORMULATED ATF (HITEC434) | | | | | | | |
| Viscosity at 40° C., cSt | 24.30 | 28.81 | 24.52 | 24.39 | 27.79 | 27.26 | 27.09 |
| Viscosity at 100° C., cSt | 6.30 | 6.83 | 6.30 | 6.30 | 6.93 | 6.83 | 6.90 |
| Viscosity Index | 230 | 232 | 227 | 229 | 227 | 227 | 233 |
| Pour Point, ° C. | −53 | −52 | −59 | −63 | −54 | −52 | −46 |
| Brookfield Viscosity, −40° cP | 3,980 | 5,870 | 3,360 | 3,170 | 5,930 | 7,680 | 12,680 |

TABLE 2

Physical Properties of Basestocks and Corresponding Formulated ATF

| BASESTOCK | | | |
|---|---|---|---|
| Wax Content of 150N wax, wt. % | 89.3. | 97 | 97 |
| Isom. Temp. (° C.) | 348 | 349 | 349 |
| Cut Point (° C.) | 360 | 370 | 390 |
| Conversion (HIVAC) | 23 | 37 | 37 |
| Wax Content (%) | 13.6 | 7.9 | 8.8 |

TABLE 2-continued

| Physical Properties of Basestocks and Corresponding Formulated ATF | | | |
|---|---|---|---|
| Viscosity 40° C., cSt | 12.25 | 13.26 | 14.74 |
| Viscosity 100° C., cSt | 3.17 | 3.36 | 3.63 |
| VI | 124 | 129 | 133 |
| Power Point (° C.) | −23 | −24 | −24 |
| Noack Volatility (250° C.), % | 32.1 | 24.5 | 18.0 |
| FORMULATED ATF (ATEC 434) | | | |
| Viscosity 40° C., cSt | 23.74 | 24.84 | 26.81 |
| Viscosity 100° C., cSt | 6.22 | 6.48 | 6.83 |
| VI | 233 | 235 | 233 |
| Pour Point, ° C. | −50 | −53 | −51 |
| Brookfield Viscosity, −40° C. cP | 4,570 | 4,460 | 6,610 |

As can be seen, isomerization of these feeds produces a base oil suitable for use as automatic transmission base stock meeting the anticipated future. Brookfield viscosity target of 10,000 and less cSt of −40° C.

Example 2

The biodegradability of the slack wax isomerate (SWI) product of the present invention was compared against that of polyalphaolefins and linear alkyl benzene. The tests employed were the 306 test of OECD (Organization for Economic Cooperation and Development) and the CECL-33-5-82 test previously described. The results are presented in Table 3.

TABLE 3

| Sample | PAO | L.A.B.[1] | 150N SWI DWO 23% Conversion [3] |
|---|---|---|---|
| KV cSt at 40° C. | 5.609 | 3.95 | 12.24 |
| KV cst at 100° C. | 1.818 | 1.322 | 3.174 |
| Pour point, ° C. | <−60 | <−60 | −24 |
| Biodegrability, % | | | |
| OCED 306 Test[2] | 20 | 3 | 45 |
| CEC L-33-T-82 Test | 75/90 | — | 83.0/99.8 |

[1]Linear Alkyl Benzenes
[2]Organization for Economic Cooperation and Development
[3] See Table 2, column 1

As can be seen, the slack wax isomerate of the present invention is possessed of an exceptionally high level of biodegradability, well in excess of that routinely established by its nearest competitor, PAO.

What is claimed is:

1. An automatic transmission fluid comprising a major portion of an isoparaffinic basestock having a viscosity at 100° C. (V100) equal to or greater than 3.0 cSt, a viscosity index less than 130 and a free carbon index (FCI) such that the product, P, in the equation $P=(V100)^2FCI$ does not exceed 50; and a minor portion of additive package comprising at least one of pour point depressants, viscosity index modifiers, flow improvers, detergents, inhibitors, seal swelling agents, anti-rust agents and antifoaming agents wherein the Brookfield viscosity of the automatic transmission fluid is less than 10,000 cSt at 40° C.

2. The fluid of claim 1 wherein the basestock viscosity at 100° C. is between 3.0 and 5.0 cSt.

3. The fluid of claim 2 wherein P is in the range of 15 to 45.

4. An automatic transmission fluid comprising a major portion of an isoparaffinic basestock having a viscosity at 100° C. (V100) equal to or greater than 3.0 cSt, a viscosity index less than 130 and a free carbon index (FCI) such that the product, P, in the equation $P=(V100)^2FCI$ does not exceed 50; and a minor portion of additive package comprising at least one of pour point depressants, viscosity index modifiers, flow improvers, detergents, inhibitors, seal swelling agents, anti-rust agents and antifoaming agents wherein the Brookfield viscosity of the automatic transmission fluid is less than 10,000 cSt at −40° C. and wherein the isoparaffinic basestock is made by a process comprising the steps of hydrotreating a wax having a mean boiling point of from 400° C. to 500° C. having a standard deviation (ρ) of about 20° C. to 45° C., containing less than about 20% oil and having a viscosity of from 4–10 cSt at 100° C., said hydrotreating being conducted in the presence of a hydrotreating catalyst have essentially no acidity at a temperature of from 280 to 400° C., a pressure of from 500 to 3000 psi, a hydrogen treat gas rate of from 500 to 5000 SCF $H_2$/B and a flow velocity of from 0.1 to 2.0 LHSV, isomerizing the hydrotreated wax over an isomerization catalyst containing a refractory metal oxide support to a level of conversion of at least 25% conversion to 370° C., fractionating the resulting isomerate to recover a fraction having a viscosity of from about 3.0 to 5.0 cSt at 100° C. and boiling above about 340° C., and dewaxing the recovered fraction.

5. The automatic transmission fluid of claim 4 wherein the isomerized hydrotreated wax component is produced by isomerizing the hydrotreated wax to a level of conversion of at least 35% conversion to 370° C. material.

6. The automatic transmission fluid of claim 4 wherein the hydrotreating catalyst is at least one of Ni/Mo on alumina, Co/Mo on alumina and Co/Ni/Mo on alumina.

* * * * *